109-83 SR
10/7/85 XR 4,615,280

United States Patent [19]
Shoop et al.

[11] Patent Number: 4,615,280
[45] **Date of Patent: * Oct. 7, 1986**

[54] HIGH SECURITY SUPPORT AND ENCLOSURE STRUCTURE FOR ELECTRONIC EQUIPMENT

[75] Inventors: James D. Shoop, Canton; Harry T. Graef, Massillon; Kevin H. Newton, North Canton; Spencer M. Grucza, Maple Heights, all of Ohio

[73] Assignee: Diebold Incorporated, Canton, Ohio

[ * ] Notice: The portion of the term of this patent subsequent to Dec. 24, 2002 has been disclaimed.

[21] Appl. No.: 547,954

[22] Filed: Nov. 2, 1983

[51] Int. Cl.[4] ..... G07G 5/00; E05G 1/00
[52] U.S. Cl. ..... 109/24.1; 109/53; 109/83; 109/50; 106/99; 52/73; 52/659
[58] Field of Search ..... 109/21, 24.1, 50–57, 109/80–85, 87; 52/294–297, 298, 73, 169.13, 659; 106/99, 36, 53; 411/2, 3; 186/36, 53

[56] References Cited

U.S. PATENT DOCUMENTS

| | | | |
|---|---|---|---|
| 1,182,651 | 5/1916 | Cuozzo | 109/56 |
| 1,421,150 | 6/1922 | Bennet | 109/83 |
| 1,607,361 | 11/1926 | Poland et al. | 109/51 |
| 1,837,501 | 12/1931 | Sunnes | 109/51 |
| 2,376,420 | 5/1945 | Davis | 109/42 |
| 2,465,057 | 3/1949 | Brandes | 109/51 |
| 3,595,124 | 7/1971 | Lindstrand et al. | 411/2 |
| 3,684,497 | 8/1972 | Wendler et al. | 109/82 |
| 3,897,901 | 8/1975 | Grosswiller, Jr. et al. | 109/24.1 |
| 3,937,121 | 2/1976 | Schubert | 411/2 |
| 4,274,881 | 6/1981 | Langton et al. | 106/99 |
| 4,377,977 | 3/1983 | Wurster | 109/83 |
| 4,399,755 | 8/1983 | Wiedmann | 109/2 |
| 4,559,881 | 12/1985 | Lankard et al. | 109/83 |

*Primary Examiner*—Gary L. Smith
*Assistant Examiner*—Neill Wilson
*Attorney, Agent, or Firm*—Ralph E. Jocke

[57] ABSTRACT

A new structure is provided comprising a cast body having enclosure, pedestal and anchor sections cast integrally of high steel fiber reinforced concrete. The enclosure section has walls forming a primary security compartment. A door movable between open and closed positions is mounted on the cast body. The door also is cast of high steel fiber reinforced concrete. The door and walls of the cast concrete body have thicknesses of at least 3 inches and resist torch and tool attack measures for at least 15 minutes. High security is provided for paper notes and valuable documents present in the primary security compartment either deposited into said primary security compartment or to be dispensed from said compartment.

21 Claims, 15 Drawing Figures

HIGH SECURITY SUPPORT AND ENCLOSURE STRUCTURE FOR ELECTRONIC EQUIPMENT

CROSS-REFERENCE TO RELATED APPLICATIONS

The improved support and enclosure structures of the invention include bodies formed of high steel fiber reinforced concrete compositions of the general types set forth in Lankard and Shoop applications, Ser. Nos. 497,824 and 524,584 filed, respectively, May 25, 1983 and Aug. 19, 1983, which application Ser. No. 524,584 has issued as U.S. Pat. No. 4,559,881 which concrete compositions impart high security characteristics to housing or enclosure structures containing electronic equipment; both said patent applications being owned by the Assignee of this application.

BACKGROUND OF THE INVNETION

1. Field of the Invention

The invention relates to electronic system equipment actuated by magnetically striped debit or credit cards issued by a financial institution and requiring user identification.

Such electronic system equipment may comprise automatic banking or teller machines (ATM) or terminals which may be installed in free-standing locations either remote from central banks or at locations accessible to customers in or adjacent central banks for dispensing paper currency or notes of one or more denominations or for accepting deposits.

Such electronic system equipment also may comprise an automated fuel system consumer terminal having components actuated by magnetically striped debit or credit cards issued by banks or oil companies and requiring user identification; or actuated by the deposit of paper currency notes into a cash acceptor preferably with associated note identifying components, to control fuel dispensing mechanism. Such fuel system consumer terminal provides for self-service card-actuated fuel purchases and payment at any time of the day or night.

Such electronic banking and fuel purchasing systems equipment, because of their free-standing state or remote location installation, and unattended condition and of their accessibility at any time of the day or night, are open to fraud, vandalism, burglary and other forms of attack, at any time, by unauthorized individuals seeking to gain access to paper currency therein and, thus, requires a high degree of security at all times.

Thus, the invention relates particularly to an attack-resistant support and enclosure structure in which electronic banking system terminals and fuel system consumer terminals are protectively housed.

Further, the invention relates to a high steel fiber reinforced concrete body formed with integrated compartment support and anchor sections, in which the anchor section may be permanently connected with anchor means in the ground, with the support section extending upward for locating the compartment section at the desired level to provide ready accessibility to a customer for actuating electronic equipment enclosed in one or more compartments in the compartment section of the body; and in which wiring for the electronic systems passes from electronic components or units protectively housed in the compartment section of the body, through the support and anchor sections, for below ground level interface communication with related power supply controllers, computers and the like.

Further, the invention relates to providing high security for and burglary and vandal resistant protection of banking system and fuel system consumer terminals by providing support and enclosure bodies for such terminals integrally formed of steel fiber reinforced concrete having a high degree of resistance to attack by cutting torches, power drills, impact hammers, abrasive cutting wheels, power saws, carbide drills, and other tools or pressure applying devices.

Finally, the invention relates to a new high security enclosure construction for electronic banking and fuel system control terminals which is characterized by having all of the features described combined in a cooperative, interrelated and integrated manner.

2. Description of the Prior Art

Typical prior art ATM electronic mechanisms, currency magazines and related equipment such as shown in U.S. Pat. Nos. 4,370,006 and 4,085,687 have been housed in enclosures or cabinets having safelike protective walls formed of traditional materials.

At least three known types of safelike protective enclosures for ATM components are known and have been used. Each such enclosure has steel plates of required thicknesses and has plates welded together and a door forming a sixth wall of a boxlike safe unit. The door closes an access opening to the unit compartment in which the electronic equipment and paper currency supplies are located.

Such boxlike safe walls have been formed of 1 inch thick mild steel plates; or of ½ inch thick high tensile strength steel plates having greater than 50,000 psi. tensile strength; or of ⅜" thick stainless steel plates. Such boxlike safe units of each of said three types has passed an Underwriters Laboratories Incorporated TL-15-UL-291 rating test, which means that the metal walls will withstand tool attack for fifteen minutes.

However, such prior steel boxlike safe units are subject to cutting torch and other heating implement attack measures, failing in one to two minutes. Such cutting torch attack measures currently are primarily used by intruders as a means of attacking ATMs.

Such prior boxlike welded steel plate safe units, thus, cannot pass an Underwriters Laboratories Incorporated TRTL-15-UL-687 rating test wherein the unit must resist cutting torch attack for at least fifteen minutes, since the prior welded steel plate boxlike safe unit when subjected to cutting torch attack and like heat oriented attack measures fails in one or two minutes.

We are unaware of any protective enclosures for ATM components or for fuel dispensing system consumer terminals which enable self-service card actuated fuel purchases to be paid for by paper currency notes accepted by the consumer terminal, which can pass both the Underwriters Laboratories Incorporated rating tests TL-15-UL-291 and TRTL-15-UL-687.

Accordingly, there is an existing need in the art for high security ATM or consumer terminal fuel dispensing controller electronic equipment enclosures or housings which can pass both of the Underwriters Laboratories Incorporated rating tests TL-15-UL-291 and TRTL-15-UL-687.

We have discovered that an enclosure, housing or safe unit for containing electronic equipment or currency notes and consumer terminal controllers for fuel dispensing systems may be formed of cast high steel fiber containing reinforced concrete which will pass the 15 minute torch and tool attack resistant tests.

Further, we have discovered that such cast high security electronic equipment enclosures, etc., may be cast integrally with pedestal support means for the enclosures and anchor means for the pedestals and enclosures, so that the unitary or integrally cast units having enclosure, pedestal and anchor sections, may be connected to anchor means located in the ground at installed locations of the units which integrated units permit power and attack-sensor means, etc., to communicate from below ground surface connections through central passage means extending through the cast unit anchor and pedestal sections to the enclosure sections.

Finally, we have discovered that such unitary high security high steel fiber reinforced concrete cast bodies may be manufactured and installed at substantially lower costs than those of prior art welded steel plate boxlike safe units which safe units have less attack resistance than the cast concrete bodies.

SUMMARY OF THE INVENTION

Objectives of the invention include providing a new cast high steel fiber reinforced concrete body having walls including a door, forming compartment means or an enclosure section, in which compartment means elctronic equipment may be housed, and protected for at least 15 minutes against tool and torch attack; providing such new attack resistant compartment container bodies with integral pedestal section which locate electronic equipment actuating means in said compartments at convenient levels above the ground where the bodies are installed for operation by users; providing such new attack resistant cast concrete bodies which may be readily varied as to size and compartment arrangement by using usual casting procedures to provide high security protection for ATM compartments, as well as for consumer terminal controller components of self-service credit card actuated fuel dispensing equipment; providing such new high security cast concrete bodies with anchor sections integrally connected with the pedestal sections, adapted for anchored connection with anchor means, either above or below ground; providin such new cast concrete unitary bodies in which passage means communicate from below ground through the anchor and pedestal sections to the protected compartment or compartments forming the cast body enclosure section; providing the described structural and functional features in cooperative and coordinated relation in such bodies so that such bodies may be easily cast and installed; and providing such new high security support and enclosure structure for electronic equipment which satisfies the indicated objectives, incorporates the stated advantageous features, and solves a long-standing problem existing in the field of dispensing currency notes, or in the field of self-service cash or credit card paid-for dispensing of fuel.

These and other objectives and advantages may be obtained by the high security support and enclosure body of the invention which may be stated in general terms as a dispensing device of the type in which materials are dispensed from or accepted into automated electronic equipment, in which paper currency notes and valuable documents to be protected are located in an equipment enclosure compartment formed by walls at least one of which is a normally locked door for a compartment access opening, and in which said walls provide security for a predetermined time against tool attack measures of an intruder, wherein the improvement comprises: a cast concrete body having an enclosure section formed of high steel fiber reinforced concrete composition having resistance to torch attack measures at least equal to its resistance to tool attack measures and having such torch and tool attack measures resistance of at least fifteen minutes; said cast concrete body including pedestal and anchor sections integral with said enclosure sections also formed of said high steel fiber reinforced concrete composition; said enclosure section having walls therein forming a primary security compartment provided with an access opening; a cast steel fiber reinforced concrete door having resistance to torch and tool attack measures substantially equal to or greater than the torch and tool attack measures resistance of said enclosure section; means for mounting the door on the cast body for movement between positions opening or closing the primary compartment access opening; and means for locking said door in closed position.

BRIEF DESCRIPTION OF THE DRAWINGS

Preferred embodiments of facets of the invention illustrative of the best modes in which applicants have contemplated applying the principles—are set forth in the following description and shown in the drawings, and are particularly and distinctly pointed out and set forth in the appended claims.

FIG. 1 or 2 is anchored in free-standing condition;

Similar numerals refer to similar parts throughout the various figures of the drawings.

DESCRIPTION OF THE PREFERRED EMBODIMENTS

Figure 1:
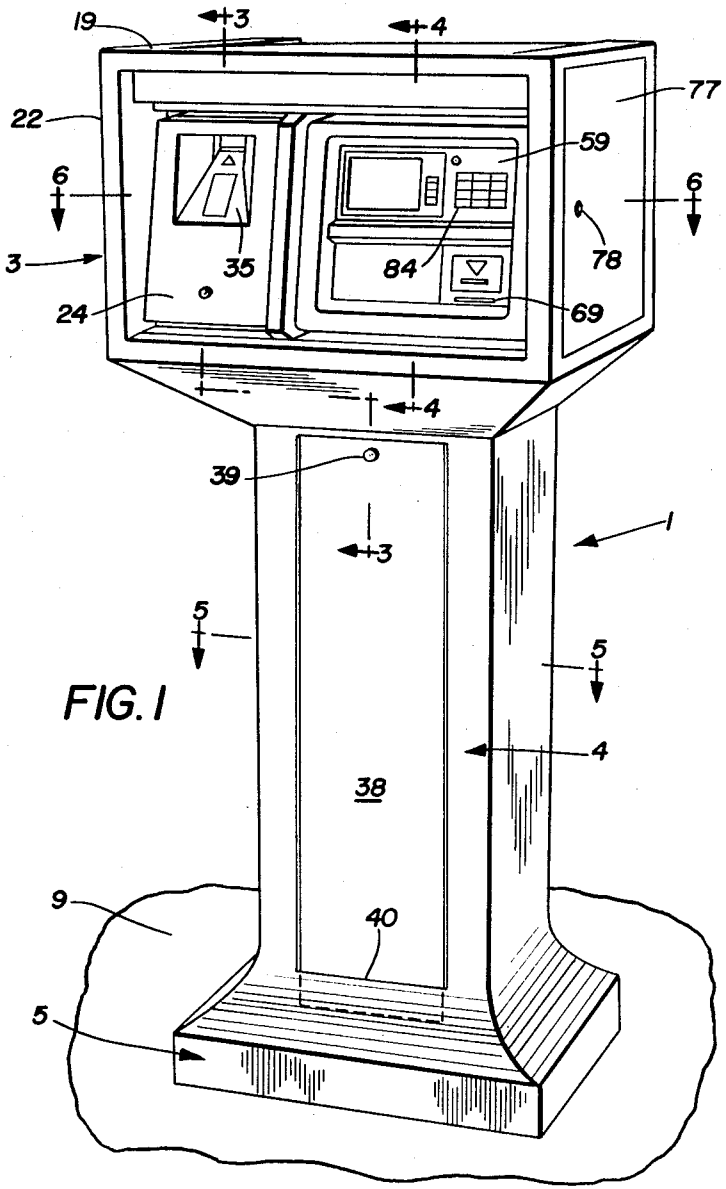
FIG. 1 is a perspective view of one form of a highly secure consumer terminal for a self-service credit card actuated fuel dispensing system controller for a gasoline pump of the invention, installed with its anchor section bolted to a typical generally ground level concrete surface, such as the surface of a pump mounting island of a gasoline service station.

A consumer terminal generally indicated at 1 in FIG. 1 has the new structure and functions of the present invention. The consumer terminal 1 is a unit in an automated fuel system which houses components actuated by magnetically striped credit cards issued by a bank or an oil company, requiring user identification, to initiate operation of an adjacent gasoline pump to dispense gasoline. The cost of the gasoline is charged to the bank or oil company account of the customer. The terminal also may be used to dispense gasoline in an amount paid for by cash in the form of paper money notes deposited in the terminal.

The cash thus deposited must be protected against unauthorized access. The new consumer terminal 1 provides a highly secure enclosure primary security compartment into which the cash is deposited, validated and identified. The terminal 1 also provides one or more secondary compartments. The highly secure primary compartment and the secondary compartments house electronic equipment components of the automated fuel dispensing system described in detail below.

Figure 2:
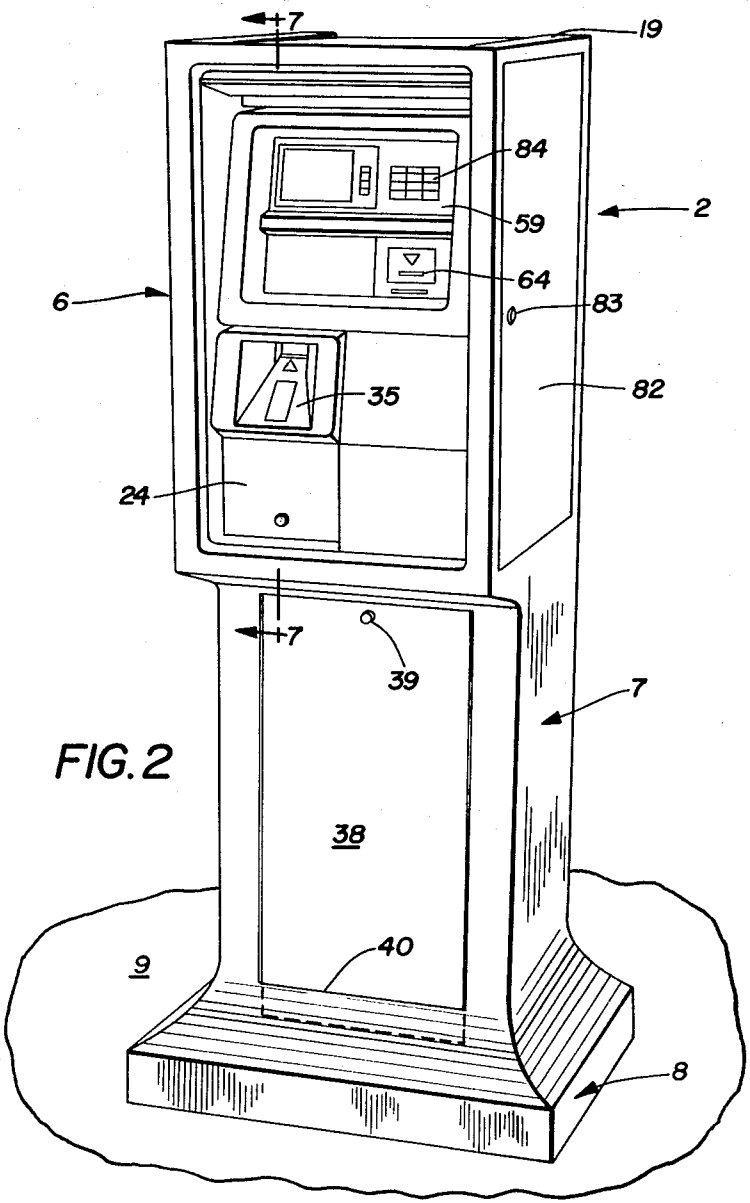
FIG. 2 is a similar view of an alternate form of such consumer terminal.

FIG. 2 illustrates a modified form of consumer terminal 2 having a different physical structural arrangement of the primary security compartment and secondary compartments in which the compartments are arranged or stacked vertically. There is a horizontal arrangement of the compartments in terminal 1.

Terminal 1 has an enclosure section indicated at 3, a pedestal section indicated at 4 and an anchor section indicated at 5. The enclosure, pedestal and anchor sections 3, 4 and 5 comprise an integral cast body of high steel fiber reinforced concrete. The concrete has a composition having resistance to torch and tool attack measures. The concrete composition and attack resistance characteristics are described in detail below.

The differently shaped structures of the terminals 1 and 2 illustrate the ease of customizing the terminals to house a variety of electronic equipment components and controls. The manufacture of terminals 1 and 2 as cast concrete bodies enables the ease of changing external shape or appearance of the terminals by mold cavity changes for the casting procedure.

A primary conceptual feature of the new cast concrete bodies of terminals such as terminals 1 or 2 is the ability of the high steel fiber reinforced concrete composition to provide, in an integral body, a composition which has high resistance to burglarious attack and which when anchored cannot be easily carried away or separated from its base.

Further, the height of the pedestal section may be easily varied, by mold changes, to accommodate the desired location of components actuated by customers, such as drive-up customers at gas stations, or walk-up customer locations of the consumer terminal.

Furthermore, the cast concrete construction of terminals 1 or 2 inherently provides smooth finished nonrusting seamless and easily waterproofed and paintable surfaces.

The terminal 2, similar to terminal 1, has integrally cast enclosure, pedestal and anchor sections 6, 7 and 8.

The anchor sections 5 or 8 of terminals 1 or 2 may be bolted (in a manner described below) to a concrete base such as a concrete pump island, the top surface of which is diagrammatically indicated at 9.

Figure 8:
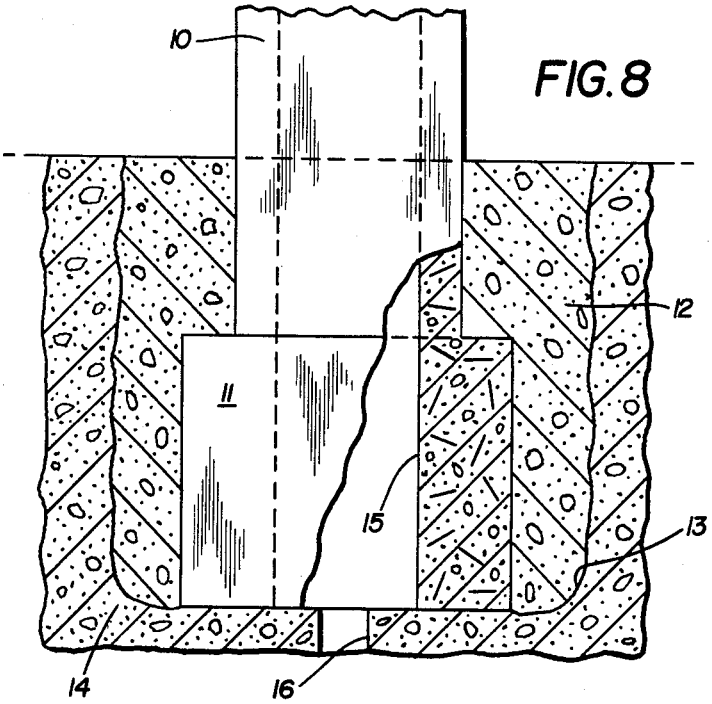
FIG. 8 is a fragmentary sectional view illustrating an alternate manner of anchoring the lower portion of the consumer terminal, of either FIG. 1 or FIG. 2, in the ground.
Figure 10:
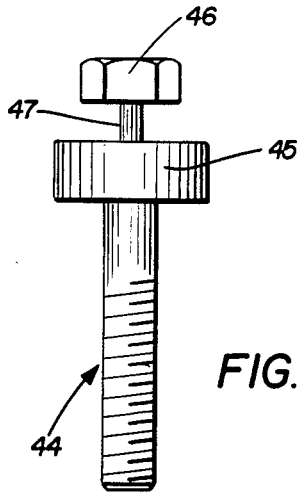
FIG. 10 is a side elevation of a special anchor bolt used to bolt the anchor section of the consumer terminal to the concrete island.

An alternate from of anchoring terminals to a concrete base is illustrated in FIG. 8 wherein the pedestal section 10 of a consumer terminal has a flangelike anchor section projection 11 which is embedded below ground in concrete 12 pured into a hole 13 formed in the ground 14 into which the anchor section is inserted prior to pouring the concrete 12.

Figure 5:
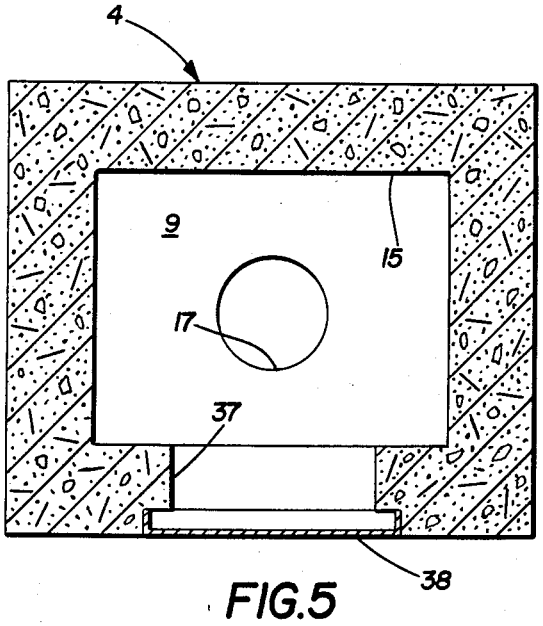
FIG. 5 is a plan sectional view on a smaller scale through the pedestal section of the consumer terminal shown in FIG. 1, taken on the line 5—5, FIG. 1, and showing a door for an opening in the pedestal providing access to the pedestal passage.

The pedestal section 4, 7 or 10 of any terminal is formed with a central passage 15 as indicated in FIG. 5. This passage 15 extends from the enclosure section 3 in terminal 1 down through pedestal and anchor sections 4 and 5 to a passage 17 in the island 9 (FIGS. 5 and 5A), or in the ground such as indicated at 16 in FIG. 8. These passages 15, 16 and 17 enable wiring of various types described below to be connected to components in the enclosure section of any terminal.

In accordance with the invention, the composition of the cast high steel fiber reinforced concrete body of the terminal structure of the invention, such as the terminal 1, is comprised of a concrete formulation which can be fully consolidated with water to cement ratios less than 0.30 and steel fiber content of 7.21 to 7.73% by weight which contains the following constituents in proportions in the following approximate ranges:

| Concrete Constituents | Lbs. | Weight % |
|---|---|---|
| Portland Cement - One of the Class Consisting of Type I and Type III Portland Cement | 830.5 to 847.5 | 18.88 to 19.81 |
| Fly Ash - One of the Class Consisting of Class F and Class C Fly Ash | 60.4 to 61.6 | 1.37 to 1.45 |
| Fine Aggregate (SSD) | 1700 to 1769 | 39.12 to 40.86 |
| Gravel - One of the Classes Consisting of No. 8 Gravel and Crushed Stone (SSD) | 1098 to 1142 | 25.12 to 26.53 |
| Water | 212 to 220 | 4.81 to 5.15 |
| Melamine Superplasticizing Water Reducing ADmixture | 42.375 to 44.125 | 0.96 to 1.04 |
| Steel Fibers - (0.016 in. diameter × $\frac{3}{4}$ in. long ± $\frac{1}{4}$ in.) | 317.5 to 330.5 | 7.21 to 7.73 |

Such reinforced concrete in a cast wall at least 3 inches thick has combined torch and tool attack resistance for a period of 15 minutes which satisfies the requirements of Underwriters Laboratories Incorporated test TRTL-15-UL-687.

Improvements in attack resistance are achieved if harder and denser coarse aggregates such as fused $AL_2O_3$ are used for all or a portion of the gravel constituent. In the preferred embodiment, $AL_2O_3$ is substituted for other gravel volumetrically at a ratio of 1:1. The specific gravity of $AL_2O_3$ is approximately 1.4 times the specific gravities of No. 8 gravel and crushed stone. Therefore the weight of the $AL_2O_3$ in a batch of the formulation is approximately 1.4 times that of the No. 8 gravel or crushed stone it replaces.

Such attack resistance overcomes problems that have existed in the art in connection with the protective enclosures provided in ATM cash dispensers of the prior type described above formed of welded steel protective walls. Such steel enclosures have been used for protecting currency to be dispensed and currency and valuable document deposits in banking media security mechanisms for automatic banking machines of types such as shown in U.S. Pat. No. 4,370,006. These prior ATM welded steel security enclosures provide only one to two minutes protection against torch attack measures.

The described favorable and highly important torch resistant protective feature is obtained in the new concrete terminal structures without sacrifice of other desired characteristics, but to the contrary, along with the other important new features of the invention described above.

Figures 3, 14:
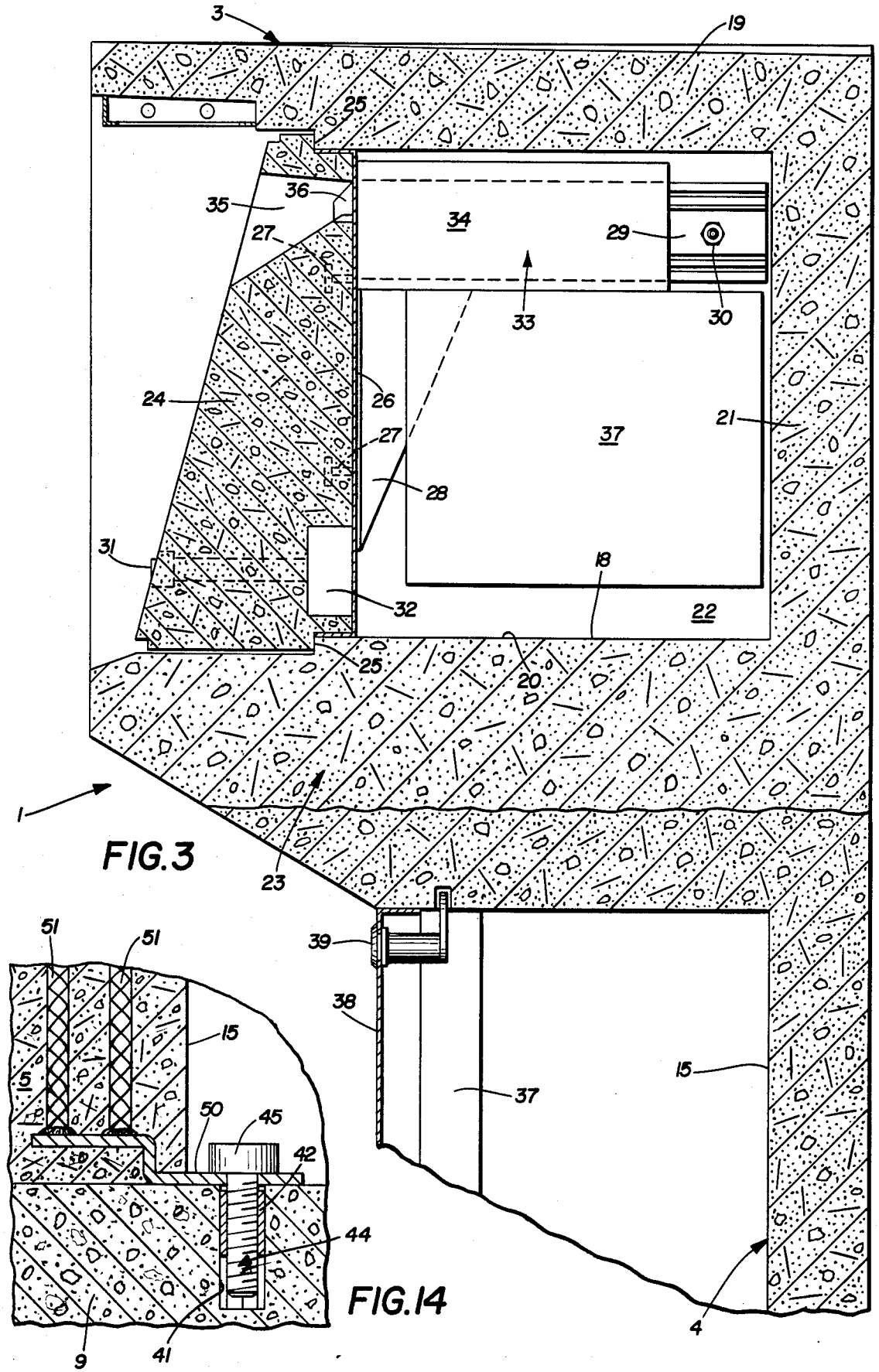
FIG. 3 is an enlarged fragmentary vertical sectional view looking in the direction of the arrows 3—3, FIG. 1.
FIG. 14 is a fragmentary section taken on the line 14—14, FIG. 5A, illustrating a bolted connection within the pedestal passage of the cast body to a concrete pump island using bolts of the type shown in FIG. 10.
Figure 6:
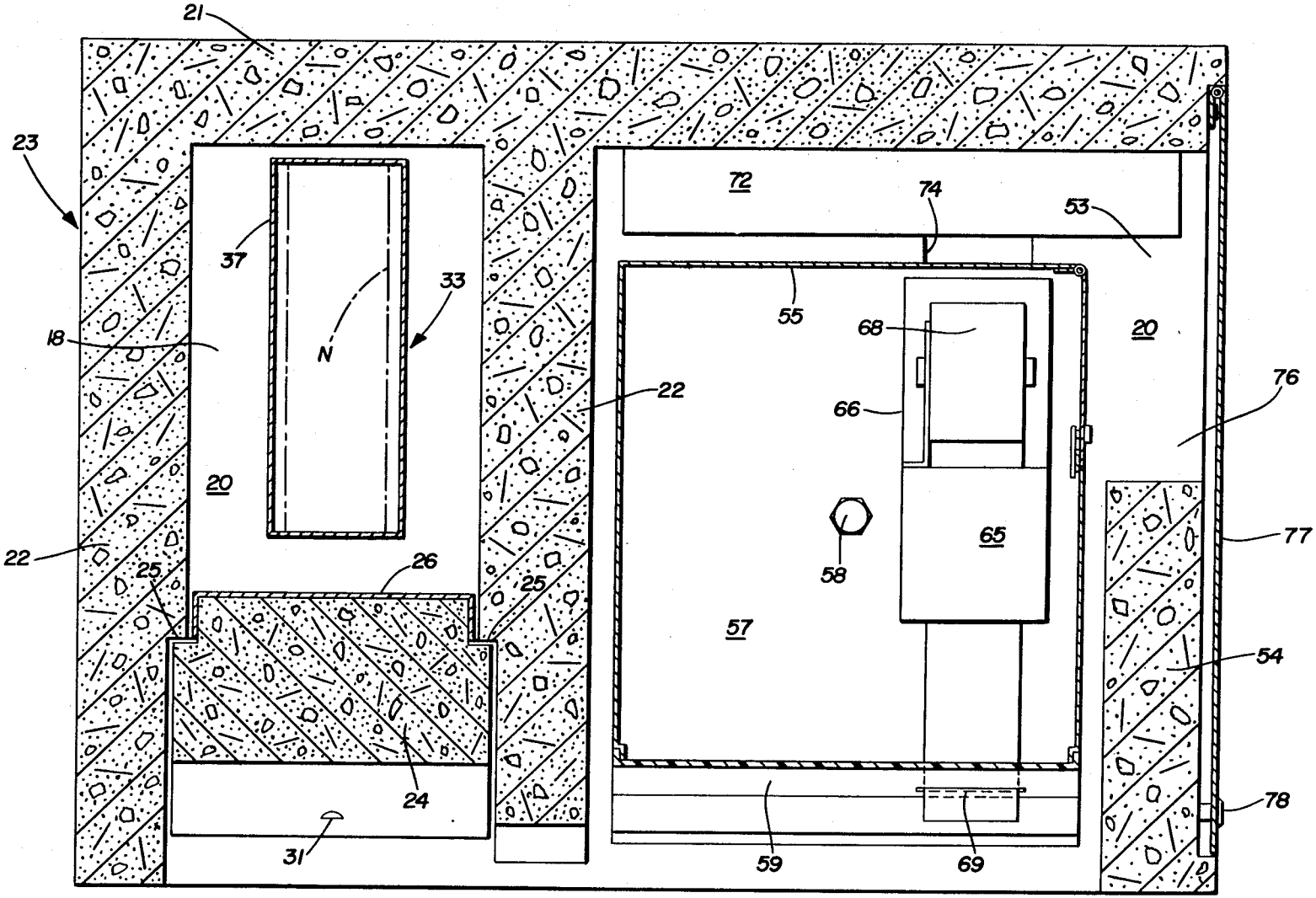
FIG. 6 is a plan sectional view taken on the line 6—6, FIG. 1.

The primary security compartment of terminal 1 is best illustarted at 18 in FIGS. 3 and 6 formed by top, bottom, rear and side walls 19, 20, 21 and 22 located in the enclosure section 23 of the terminal 1. These cast reinforced concrete compartment walls 19 to 22, in accordance with the invention, are at least 3 inches thick to provide the 15-minute protection described against torch and tool attack.

The access opening at the front or left end (FIG. 3) of the primary security compartment 18 is closed by a cast steel fiber reinforced concrete door 24 which has a shouldered perimeter seated against the shoulder 25 forming the compartment access opening walls. The door 24 has an inner sheet metal flange panlike cover member 26 cast integrally with the door and secured to the concrete by headed metal connectors 27 welded to the member 26 and extending into the mold cavity during casting of the door 24.

Metal strut support members 28 project rearwardly from and are welded to the side edges of the pan member 26 and are welded to one of the telescoping members of typical telescoping drawer suspension means 29. The other members of a pair of spaced suspension means 29 are mounted at 30 on the side walls 22 of the compartment 18.

Lock means 31 with an actuating shaft extending to the lock and bolt case 32 is provided for the door 24. When locked the bolts are engaged in bolt keepers embedded in one or both side walls 22 of the compartment 18. The lock means 31 may be either typical key or combination actuated locks known in the safe and vault art.

When the lock means 31 is in unlocked state, the door 24 may be moved on the suspension 29 in a typical manner, such as in known operation of suspension mounted drawers in filing cabinets, between positions opening or closing the primary security compartment 18 access opening.

A cash acceptor, generally indicated at 33, may be removably mounted on the struts 28 or on the door mounted components of the suspension device 29. This cash acceptor has electronic equipment in acceptor case 34 and may be a Bill Acceptor, Model OBAX, of Rowe International, Inc., 75 Troy Hills Road, Whippany, N.J. 07981; or a Banknote Acceptor, S2000, or Ardac, Inc., 34000 Vokes Drive, Eastlake, Ohio 44094.

Cash in the form of paper currency of multiple denominations for purchasing gasoline is entered through opening 35 in the door 24 into entry slot 36 of th cash acceptor 33. The cash acceptor electronic equipment and components in the case 34 determine the validity of the deposited notes, that is, whether or not counterfeit, and the denomination of each note. Then the currency is dropped from the case 34 into a cash accumulator or stacker box 37 connected with the cash acceptor 33. Such notes are indicated at N in FIG. 6. The information generated in electronic equipment in the cash acceptor 33 is then transmitted through wiring to the gasoline pump controller to enable dispensing operation of the pump.

Although the door 24 may be cast of the reinforced concrete having the same compositions as that from which the cast body is cast, it is preferred to form the door 24 of high steel fiber reinforced concrete which comprises a concrete phase reinforced with steel fiber and ceramic aggregate phases, having a steel fiber phase of 5% to 10% by volume, a concrete phase containing hydraulic cement, and a ceramic aggregate phase having a maximum particle size of $\frac{5}{8}$" to 4". This particular reinforced concrete composition and its properties and preparations are described in said application Ser. No. 497,824, filed May 25, 1983.

It is noted that the composition of the concrete from which the terminal 1 is cast and its properties and preparation are described in said aplication Ser. No. 524,584, filed Aug. 19, 1983.

Such preferred reinforced concrete door composition also has the 15-minute resistance to torch and tool attack in walls having a thickness of 3 or more inches. In accordance with the invention, since the door 24 in cross section increases in thickness from top to bottom, and since it has at least a 3 inch thickness, the door provides at least the same attack resistance that is provided by the cast body.

The pedestal section of the consumer terminals of the invention, such as the pedestal section 4 of terminal 1 (FIGS. 1, 3 and 5), preferably is provided with an access opening 37 preferably in its front wall which is closed by a pedestal door 38 provided with lock means 39 for locking the door 38 in place. The door 38 may be removed by unlocking the lock 39 and raising the door so that its lower end disengages a lateral top opening slot 40 formed in the pedestal section 3 adjacent the lower end of the opening 37.

Figure 9:
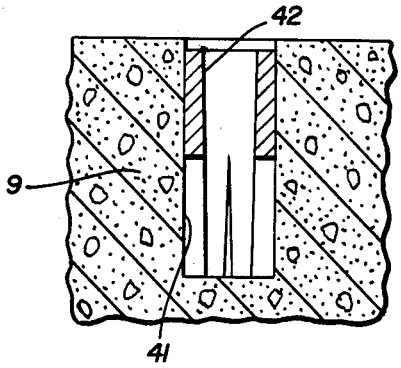
FIG. 9 is a fragmentary somewhat enlarged sectional view of a portion of a concrete island or base to which the anchor section of an improved cast highly secure consumer terminal of either
Figure 11:
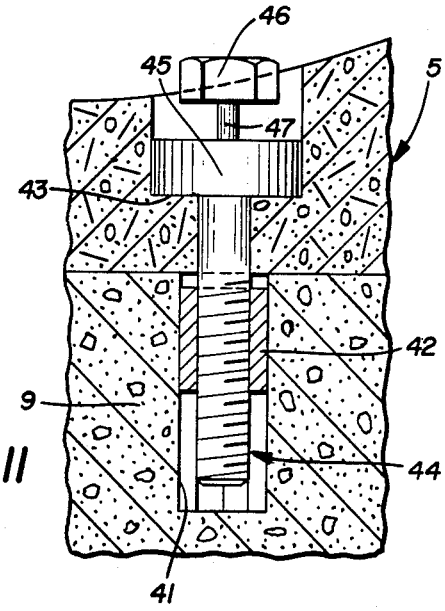
FIG. 11 is a view similar to FIG. 9 showing the anchor bolt of FIG. 10 extending through an opening formed in the anchor section of a consumer terminal and screwed into an expansion anchor device located in the concrete island of FIG. 9.

Bolted anchoring of terminals, such as the terminals 1 or 2, to a concrete base is shown in FIGS. 9 through 13. Holes 41 are drilled in a concrete base to which the terminal is to be anchored, such as the pump island base 9 of FIG. 1 or 2. These holes 41 are drilled at spaced intervals around the anchor section 5, one of which is shown in FIG. 9, and bolt expansion sleeve retainers 42 are inserted in such holes 41. Similarly located shouldered holes 43 are formed in anchor section 5 (FIG. 11) and the anchor section is placed on the base 9 with the holes 43 matching the holes 41 and anchor bolts generally indicated at 44 are screwed into the expansion sleeves 42 until circular heads 45 seat in the shouldered holes 43.

Figure 12:
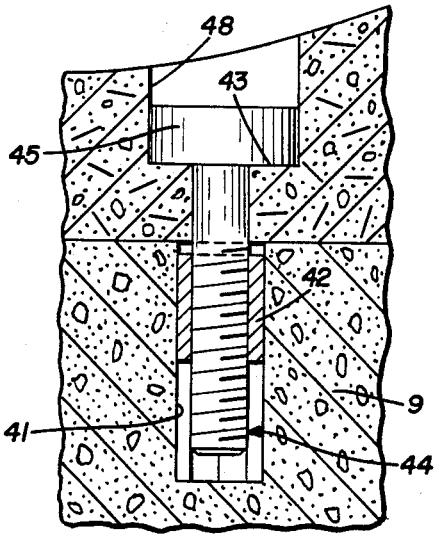
FIG. 12 is a view similar to FIG. 11 showing an anchor bolt hex head at the top of the anchor bolt of FIGS. 10 and 11 broken from the remainder of the bolt after screwing the bolt into the expansion device located in the concrete island.
Figure 13:
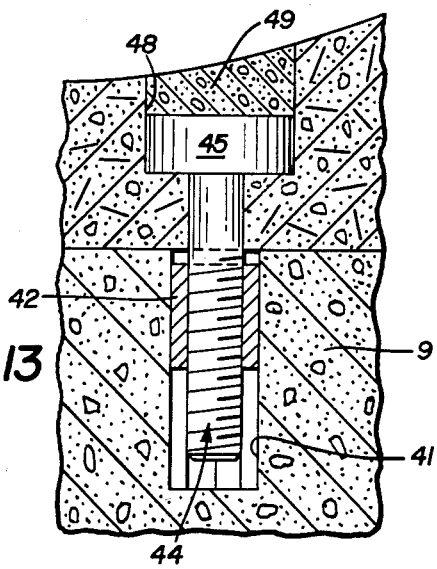
FIG. 13 is a view similar to FIGS. 11 and 12 showing the portion of the hole in the anchor section of the consumer terminal above the anchored anchor bolt filled with concrete to cover, conceal and protect the anchor bolt.

The hex heads 46 of the bolts 44 connected by the slender bolt portions 47 with the heads 45 are then twisted off so that a hole opening portion 48 remains above the circular bolt heads 45 in the anchor section 5 of the cast body as shown in FIG. 12. These hole openings 48 then are filled with concrete 49 to conceal the bolt heads and their location so as to deter access to the bolts which cannot be unscrewed from the anchor sleeves 42 without breaking away the anchor section of the terminal by tool attack which is resistant by the reinforced concrete in the anchor section 5 of the terminal (FIG. 13).

Figure 5A:
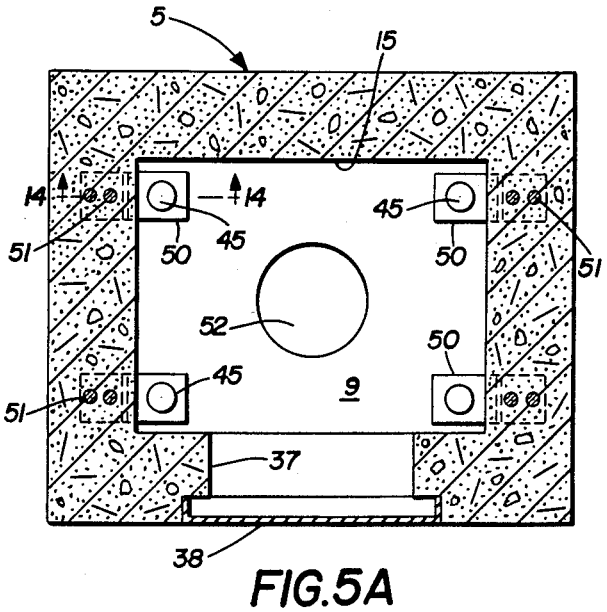
FIG. 5A is a view similar to FIG. 5 but illustrating an alternate manner of bolting the pedestal and anchor sections of the cast body to a concrete pump island of a gasoline service station.

An alternate manner of concealing or rendering inaccessible the bolting of a terminal, such as terminals 1 or 2, is illustrated in FIGS. 5A and 14 wherein the holes 41 are drilled in the base 9 at locations within the area defined by the passage 15 of a pedestal section 4.

Z-shaped metal connectors 50, with portions embedded in the lower end of the anchor section 5 of the terminal (FIG. 14) and welded to reinforcing bars 51 in the cast concrete body, project into the passage 15 and are formed with openings matching the location of the holes 41. Anchor bolts 44 are inserted through the connector openings and screwed into the expansion sleeves 42 and the hex heads broken off so that the bolts 44 cannot be unscrewed.

The passage 15 in the pedestal and anchor sections (FIGS. 5 and 5A) communicates with a passage in the ground by a passage opening 17 (FIGS. 5 and 5A) similar to the ground opening 16 of FIG. 8.

Figure 4:
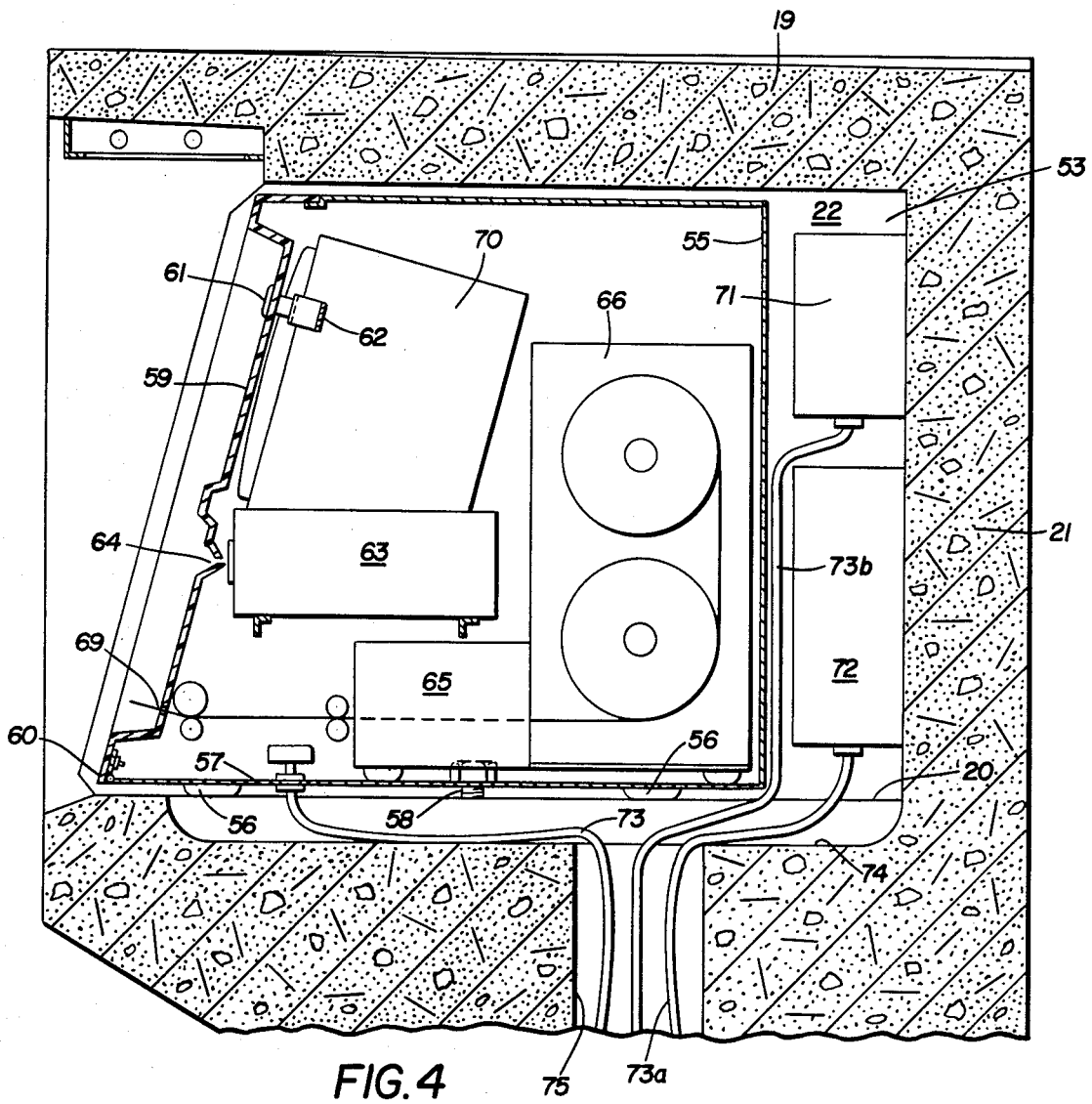
FIG. 4 is a similar sectional view looking in the direction of the arrows 4—4, FIG. 1.

A secondary compartment 53 formed in the enclosure section 3 of terminal 1 is best illustrated in FIGS. 4 and 6. Secondary compartment 53 is defined by top wall 19, bottom wall 20, rear wall 21 and end wall 22 common for adjacent primary security compartment 18 and secondary compartment 53, and an outer end wall 54 (FIG. 6).

An equipment container indicated at 55 is located in secondary compartment 53. The container 55 is preferably formed by boxlike sheet metal walls having feet 56 resting on concrete bottom wall 20, and the bottom wall 57 of container 55 preferably is bolted at 58 to the enclosure section bottom wall 20.

The open end of the equipment container 55 is closed by a fascia closure member 59 hinged at 60 to the container 55. Closure 59 may be locked by lock means 61 mounted on closure member 59 and latched to keeper means 62 connected (not shown) with the equipment container 55 or to equipment located in the container.

Various electronic equipment components are housed in container 55 such as components of ATMs used for actuating and controlling operation of cash dispensers, which known equipment may be used for actuating and controlling the consumer terminal 1.

Such known equipment may include, for example, a card reader 63 for reading credit cards inserted through the card slot 64 in the fascia 59 for actuating the electronic equipment controlling the fuel pump for dispensing fuel. Other components may include a receipt printer 65, a paper tape unit 66 containing two tape spools 67 and 68 on which the receipts are printed. One of the tapes contains receipts presented to the customer at a receipt slot 69 in the fascia 59, and the other tape is retained in one of the components. Such components also may include a CRT or TV screen 70 which displays instructions to a consumer customer as to the steps or manner in which the terminal 1 is operated.

Other electronic equipment components housed in the secondary compartment 53 are indicated at 71 and 72 which form part of the automated system for dispensing fuel such as a pump controller.

The various components in the secondary compartment 53 and in equipment container 55 may operate with power supplied for the components, and may transmit signals to the fuel dispensing system and pumps controlled thereby through wiring 73, 73A and 73B which may pass along a channel 74 formed in the enclosure section bottom wall 20 and then through a passageway 75 which connects with the central passage 15 of the terminal 1.

Secondary chamber 53 also preferably has an access opening 76 in its outer side wall 54 through which adjustments, repairs, replacements and new tape rolls are supplied. Opening 76 is closed by a hinged door 77 having a lock 78 (FIGS. 1 and 6).

The fascia closure member 59 preferably is formed of plastic material but also may be formed of fiber glass or sheet metal. Similarly, the door 77 may be formed either of plastic material or sheet metal. Surface portions of the door 77 or of the fascia 59 provide convenient areas for displaying advertising for the service station equipped with the automated fuel system equipment housed in the consumer terminal 1.

Figure 7:
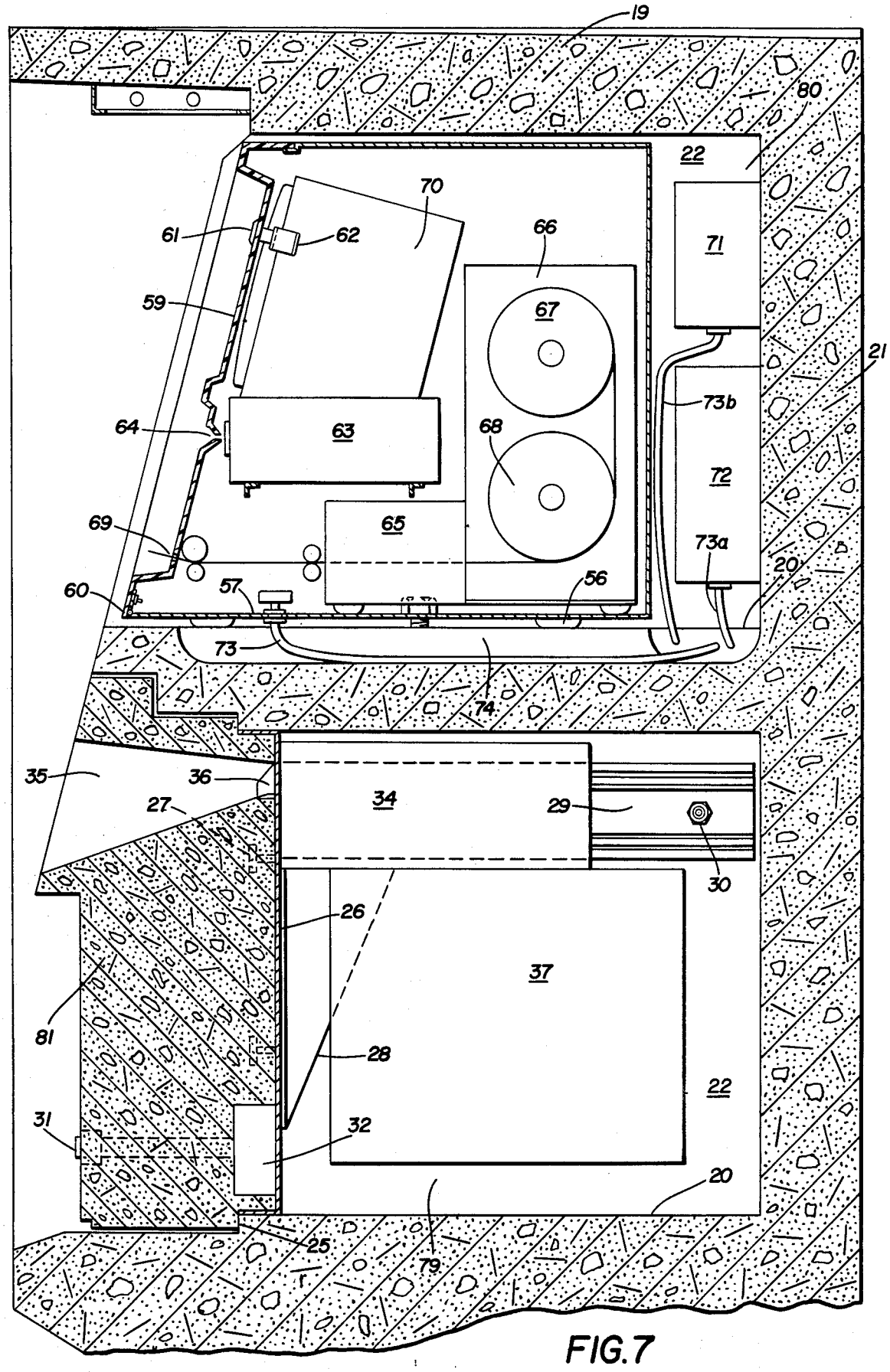
FIG. 7 is a fragmentary vertical sectional view looking in the direction of the arrows 7—7, FIG. 2.

A vertical arrangement of the primary security compartment and the secondary compartment of the terminal illustrated in FIG. 2 is best shown in FIG. 7 wherein the primary compartment 79 is located below the secondary compartment 80. The high steel fiber reinforced concrete door 81 is similar in function, mounting and operation to the door 24 of FIG. 3, except that the door 81 has a somewhat different cross-sectional shape at least 3 inches in thickness.

Other components or devices associated with the door 81 and primary compartment 79 may be the same as those in FIG. 3.

Similarly, the various components and equipment illustrated in the secondary compartment 80 of FIG. 7 may function and operate and be assembled in a manner similar to that shown in FIG. 4.

Further, the terminal 2 of FIG. 2 may have a door 82 having a lock 83 closing an access opening, not shown, communicating withteh secondary compartment 80.

The fascia 59 of each of terminals 1 and 2 may have keyboards 84 through which information may be entered into the terminal indicating the fuel gallonage desired when credit card operated or the value of the paper money inserted when cash operated.

The fascia 59 is similar to and has some of the same items that are present in the fascia of the cash dispenser of U.S. Pat. No. 4,370,006, such as the keyboard, the credit card entry slot, a receipt issuing slot and a TV screen.

Thus, a fascia similar to fascias 59 for the terminals in FIGS. 1 and 2 may be used for a secondary compartment or compartments of a similar high steel fiber reinforced concrete terminal construction similar to those of FIGS. 1 and 2 which also has a primary security compartment in which bank note supplies in different denominations to be dispensed, and a deposit-receiving container are located to provide the enhanced 15 minute torch and tool attack resistance for such an ATM cash dispensing and deposit-receiving unit which, in the past, has only had one to two minutes torch attack resistance as described above.

Accordingly, the new high security support and enclosure structure for electronic equipment of the invention provides primary security compartment means and secondary compartments in a cast reinforced concrete body having integral pedestal and anchor sections providing enhanced burglary-attack resistance for paper currency notes and valuable documents contained in the primary security compartment for dispensing from the primary compartment or being deposited in the primary compartment.

Accordingly, the new structure, in its various forms, provides a structure achieving the stated objectives, eliminating difficulties that have been encountered with prior art structures, solving an important problem that has existed in the art, and obtaining the described new results.

In the foregoing description certain terms have been used for brevity, clearness and understanding, but no unnecessary limitations are to be implied therefrom, beyond the requirements of the prior art, because such terms are used for descriptive purposes and are intended to be broadly construed.

Moreover, the description and illustration of the invention are by way of example, and the scope of the invention is not limited to the exact details shown or described.

Having now described the features, discoveries and principles of the invention, the manner in which the security structure is constructed and formulated, and the advantageous, new and useful results obtained, the new and useful structures, devices, elements, arrangements, and compositions are set forth in the appended claims.

We claim:

1. An attack resistant castable concrete housing for electronic components, comprising:

a body;

an enclosure section within said body enclosing said electronic components;

said body being comprised of a castable concrete composition which can be fully consolidated when cast with water to cement ratios less than 0.30 and steel fiber content of 7.21% to 7.73% by weight, consisting essentially of:

| Constituents | Weight % |
|---|---|
| Portland Cement wherein said cement is selected from the group consisting of Type I and Type III Portland Cement; | 18.88 to 19.81 |
| Fly Ash wherein said fly ash is selected from the group consisting of Class F and Class C fly ash; | 1.37 to 1.45 |
| Fine Aggregate (SSD); | 39.12 to 40.86 |
| Gravel wherein said gravel is selected from the group consisting of No. 8 gravel and crushed stone, (SSD); | 25.12 to 26.53 |
| Water; | 4.81 to 5.15 |
| Melamine Superplasticizing Water Reducing Admixture; and, | 0.96 to 1.04 |
| Steel fibers; | 7.21 to 7.73. |

2. The housing according to claim 1 wherein $Al_2O_3$ is substituted for a portion of the gravel constituent volumetrically at a ratio of 1:1.

3. The housing according to claim 2 and further comprising:

an access opening in said body providing access to the enclosure section;

a door for closing said access opening;

mounting means for mounting the door to the body;

hinge means enabling movement of the door between positions opening and closing the access opening; and locking means for locking the door in closed position.

4. The housing according to claim 3 wherein the door is comprised of a concrete composition which can be fully consolidated when cast with water to cement ratios less than 0.30 and steel fiber content of 7.21% and 7.73% by weight, consisting essentially of:

| Constituents | Weight % |
|---|---|
| Portland Cement wherein said cement is selected from the group consisting of Type I and Type III Portland Cement; | 18.88 to 19.81 |
| Fly Ash wherein said fly ash is selected from the group consisting of Class F and Class C fly ash; | 1.37 to 1.45 |
| Fine Aggregate (SSD); | 39.12 to 40.86 |
| Gravel wherein said gravel is selected from the group consisting of No. 8 gravel and crushed stone, (SSD); | 25.12 to 26.53 |
| Water; | 4.81 to 5.15 |
| Melamine Superplasticizing Water Reducing Admixture; and, | 0.96 to 1.04 |
| Steel fibers; | 7.21 to 7.73. |

5. The housing according to claim 4 wherein said body includes pedestal and anchor sections.

6. The housing according to claim 5 and further comprising a passage from the exterior of the body to the enclosure section extending through the pedestal and anchor sections, said passage enclosing wiring from the electronic components running to the exterior of the body.

7. The housing according to claim 6 and further comprising anchoring means for anchoring the anchor section to the ground.

8. The housing according to claim 5 and further comprising:

at least one secondary enclosure section in the body housing components of the electronic equipment not requiring high security protection;

a secondary access opening for at least one secondary enclosure section;

a secondary door closing at least one secondary access opening;

secondary hinge means enabling movement of the secondary door between positions opening and closing the secondary access opening; and locking means for locking at least one secondary door in position closing the secondary access opening.

9. The housing according to claim 1 wherein the electronic components comprise electronic banking equipment.

10. The housing according to claim 1 wherein the electronic components comprise electronic fuel control equipment.

11. The housing according to claim 7 in which the anchor section comprises an outwardly extending flangelike portion at the lower end of the pedestal section; and in which the anchor section flangelike formation is buried in a concrete base in the ground.

12. The housing according to claim 11 in which the anchor section is bolted by bolt means to a concrete base located in the ground; and in which the bolt means are concealed.

13. The housing according to claim 12 in which the anchor section comprises an outward extending flangelike portion at the lower end of the pedestal section; in which the concealed bolts are located in the flangelike portion and are bolted to anchor means in a concrete base in the ground.

14. The housing according to claim 12 in which the bolt means are located within the passage extending through the pedestal and anchor sections; and in which said bolt means engage metal ears welded to reinforcing bars in the cast body which metal ears project into said passage.

15. The housing according to claim 8 wherein one secondary enclosure section is provided with first and second secondary access openings communicating between said secondary enclosure section and the exterior of the body; in which each of said first and second secondary access openings is provided with door means; and in which lock means is provided for each of said door means.

16. The housing according to claim 15 wherein the body has front and side outer surfaces; in which said first secondary access opening is accessible at the front outer surface; and in which said second secondary access opening is accessible at a side outer surface adjacent said front outer surface; whereby said components housed in said one secondary enclosure section may be serviced through either of said first and second secondary access openings when said doors are unlocked and opened.

17. The housing according to claim 16 wherein the door means for said first secondary access opening is formed of material of the class consisting of plastic, fiber glass, and metal; and in which the door means for said second secondary access opening is formed of material of the class consisting of plastic and metal.

18. The housing according to claim 6 in which alarm grid wiring means is cast in the body having wiring connections passing through said passage in said pedestal and anchor sections adapted for connection with police alarm receivers and the like to signal the existence of attack measures to which the body is being subjected.

19. The housing according to claim 6 in which said pedestal section has an opening formed therein communicating between the exterior of the pedestal section and said passage; and in which a pedestal door provided with lock means is mounted on the pedestal section to close said opening.

20. The housing according to claim 3 wherein the door is comprised of concrete consisting essentially of:

| Component | Volume % |
|---|---|
| Cement | 50–70 |
| Ceramic Aggregate | 25–40 |
| Steel Fibers | 5–10 |

said cement consisting of:

| |
|---|
| 824 parts by weight Type III Portland Cement; 457 parts by weight water; and 93 parts by weight melamine super plasticizing Admixture. |

21. The housing according to claim 20 wherein the ceramic aggregate is selected from the group consisting of fused $A_2O_3$, $S_iO_2$ and refractory carbides.

* * * * *